United States Patent [19]

Malacheski et al.

[11] 4,196,603

[45] Apr. 8, 1980

[54] COMBINATION PUSH-BUTTON LOCK

[76] Inventors: Joseph J. Malacheski; Richard J. Zenda, both of 32 Warner St., Plains, Pa. 18705

[21] Appl. No.: 952,701

[22] Filed: Oct. 19, 1978

[51] Int. Cl.[2] ..... E05B 37/00

[52] U.S. Cl. ..... 70/313; 70/299; 70/333 R

[58] Field of Search ..... 70/1.5, 1.7, 214, 220, 70/301, 313, 333, 299

[56] References Cited

U.S. PATENT DOCUMENTS

| | | | |
|---|---|---|---|
| 1,227,535 | 5/1917 | Greif | 70/313 |
| 1,587,044 | 6/1926 | Solomon | 70/313 |
| 3,667,261 | 6/1972 | McGourty | 70/301 |

*Primary Examiner*—Robert L. Wolfe

*Attorney, Agent, or Firm*—Robert K. Youtie

[57] ABSTRACT

A combination push-button lock wherein a bolt is shiftably mounted in a body for movement between locked and unlocked positions, a rotor being mounted internally of the body and carrying an operator for unlocking the bolt upon predetermined rotor rotation, rotor being rotatable by selective movement of shifters generally tangent to and engageable in turning engagement with selectively located turning tabs on the rotor.

11 Claims, 8 Drawing Figures

FIG. 1
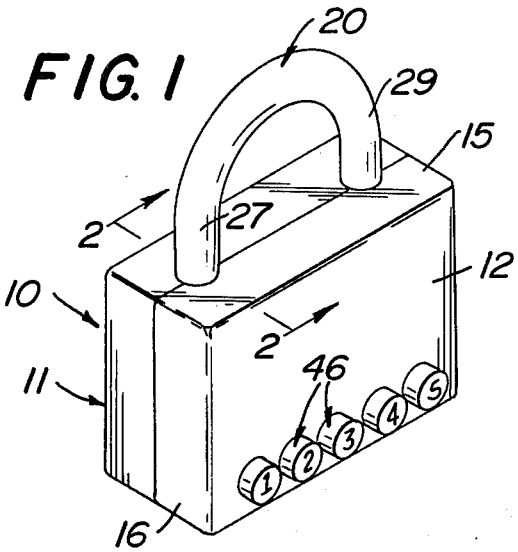
FIG. 2
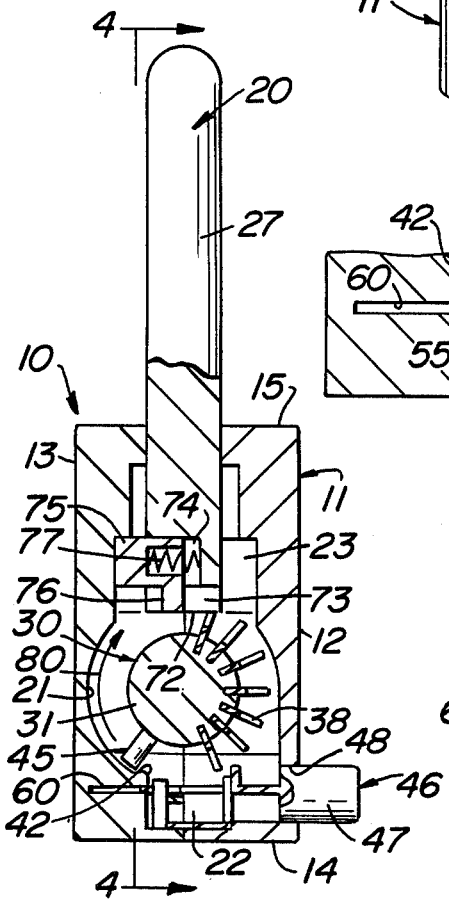
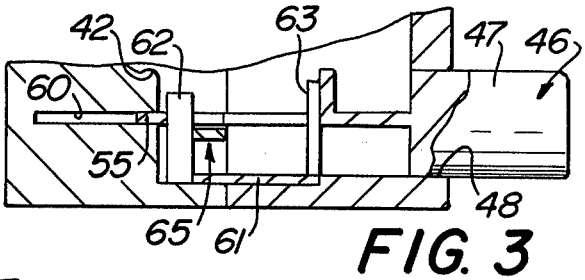
FIG. 3
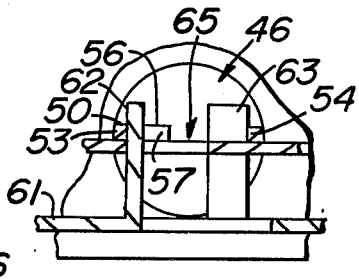
FIG. 5

FIG. 4
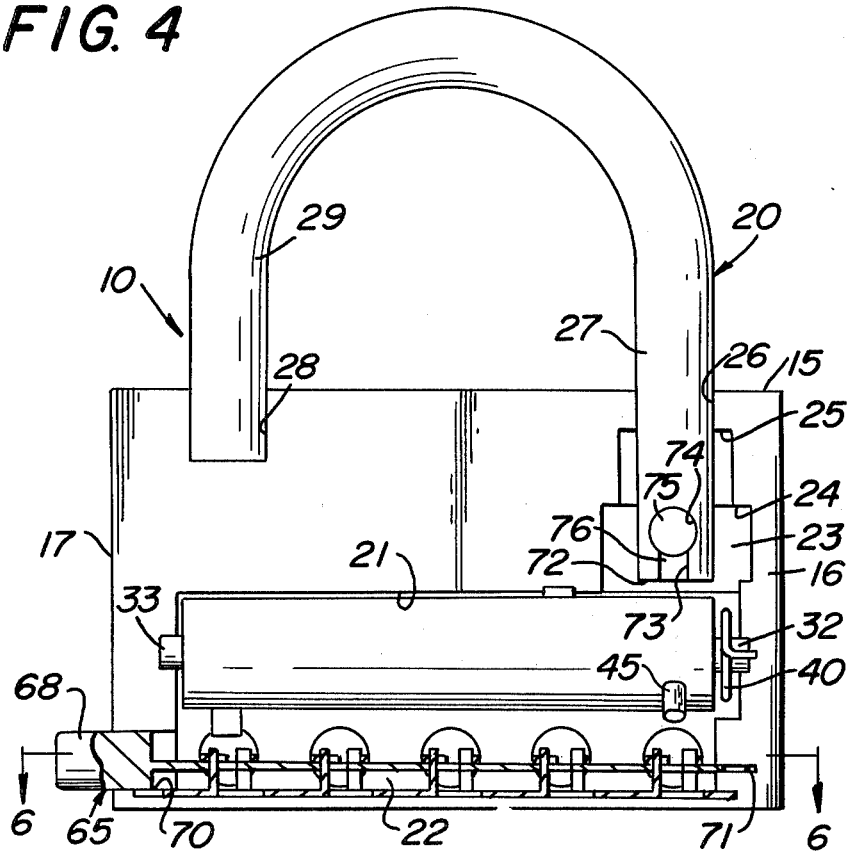
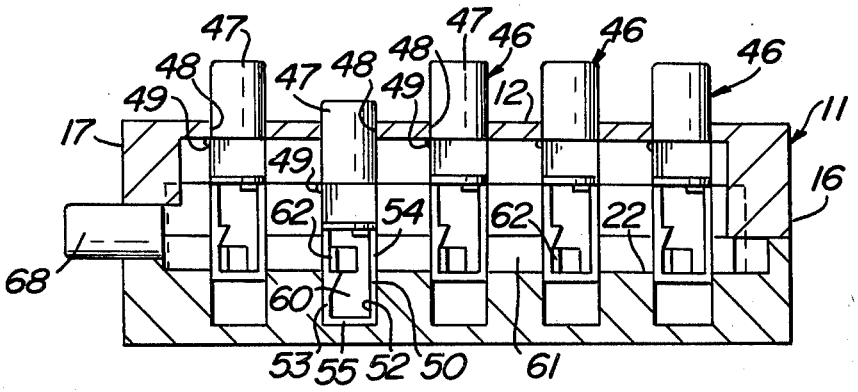
FIG. 6

COMBINATION PUSH-BUTTON LOCK

BACKGROUND OF THE INVENTION

The combination push-button lock of the present invention has been primarily developed for use in padlocks, and is illustrated and described hereinafter with particular reference thereto, but it is appreciated that certain advantageous characteristics of the instant invention may be capable of broader application, all of which is intended to be comprehended herein.

While the overall concept of push-button combination locks is not new, there has not been heretofore proposed a push-button combination lock sufficiently simple, durable, inexpensive and of satisfactory security and integrity to achieve wide commercial acceptance.

SUMMARY OF THE INVENTION

Accordingly, it is an important object of the present invention to provide a combination lock which is extremely simple in structure, requiring a minimum of relatively inexpensive components and capable of quick and easy assembly, wherein integrity and durability of lock structure may be achieved with economy in manufacture for sale at a reasonable cost, and further wherein an extremely high number of possible lock combinations are provided to permit of mass production in substantial quantities without appreciable dilution of security.

It is still another object of the present invention to provide a combination lock construction of the type described which is uniquely well-suited for incorporation in padlocks, affording great ease of operation by push-button opening, and which is highly resistant to tampering and picking even by skilled persons having considerable time.

It is still another object of the present invention to provide a combination lock having the advantageous characteristics mentioned in the preceding paragraphs, and overcoming the difficulties of the prior art, which is staunch and reliable in design and operation throughout a long useful life, and otherwise well adapted to meet its intended objects.

Other objects of the present invention will become apperent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 1 is a front perspective view showing a padlock constructed in accordance with the teachings of the present invention.

FIG. 2 is a sectional elevational view taken generally along the line 2—2 of FIG. 1.

FIG. 3 is a partial sectional view similar to FIG. 2, enlarged for clarity.

FIG. 4 is a sectional elevational view taken generally along the line 4—4 of FIG. 2.

FIG. 5 is a partial sectional view similar to FIG. 4, but enlarged for clarity.

FIG. 6 is a horizontal sectional view taken generally along the line 6—6 of FIG. 4.

DESCRIPTION OF THE PREFERRED EMBODIMENT

Figure 7:
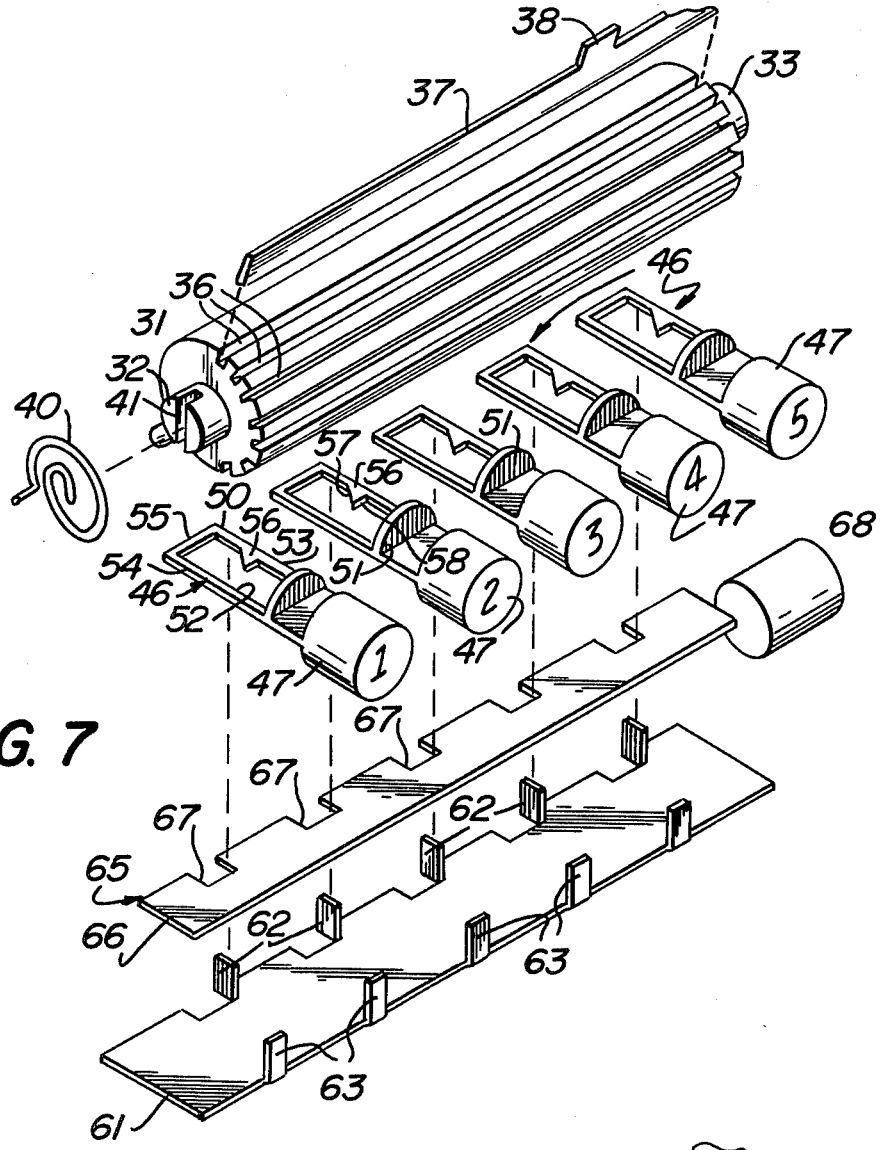
FIG. 7 is an exploded perspective view showing certain internal operative components of the instant lock, apart from the body thereof.
Figure 8:
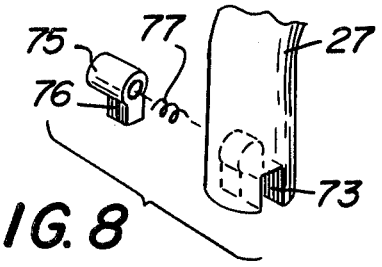
FIG. 8 is a partial exploded perspective view showing the shackle locking means of the present invention.

Referring now more particularly to the drawings, and specifically to FIGS. 1, 2 and 4, a combination lock is shown therein and generally designated 10, which is illustrated and described hereinafter as a push-button operated combination padlock. The padlock may include a generally flat body 11 having a front face 12, back face 13, lower and upper edges 14 and 15, and a pair of side edges 16 and 17. A bolt 20, say in the form of a generaly U-shaped shackle may project upwardly from the upper face 15.

The padlock body 11 may be internally configured to provide, in its lower region, a laterally elongate, generally cylindrical hollow or cavity 21 which opens downwardly into a generally horizontally or laterally extending trough 22. The trough 22 is generally longitudinally coextensive with the cylindrical hollow 21 and opens upwardly into the latter. In addition, adjacent to one body end wall 16 there is formed a generally vertically extending internal cavity or hollow 23 which opens downwardly into the chamber 21, adjacent to one end thereof. The hollow or cavity 23 is provided, at a vertically intermediate location, with a downwardly facing shoulder 24, and terminates at its upper end in a downwardly facing shoulder 25 adjacent to and spaced below the upper body edge face 15. A guide hole 26 extends from the chamber 23 exteriorly, opening upwardly into the upper end wall 25, and outwardly through the upper body face 15. The shackle 20 includes a leg 27 slidably received in body hole or opening 26 for entry into hollow 23. A blind hole 28 may be formed in the upper body face 15, spaced from the hole 26, for removably receiving the other shackle leg 29.

As is apparent in the drawings, the padlock body 11 may be economically and expeditiously fabricated of a pair of complementary, facing sections suitably secured together, as by welding, or other securing means. The facing sections may have their facing sides suitably recessed to define the hereinbefore described internal body formations.

Located generally conformably within the laterally extending cavity 23 is a generally cylindrical roll or rotor 30. In particular, the rotor 30 may include a horizontally or laterally extending elongate member 31 of generally circular cross section, and may be provided with a pair of oppositely outwardly extending, coaxially aligned pintles 32 and 33, respectively journaled in adjacent ends of chamber 21. A plurality of longitudinally extending, angularly spaced apart and radially outwardly opening grooves or slots 36, see FIG. 7, are formed in elongate rotor member 31, each being adapted to carry a respective strip 37 having a radially outstanding projection or turning tab 38. The tabs 38 of the different strips 37 are provided at spaced locations longitudinally of the rotor member 31, and spaced locations angularly thereabout.

Suitable resilient means, such as a spiral spring 40 may be circumposed about the pintle or axle 32, having one spring end anchored to the pintle, as in a diametral slot 41. That is, the inner end of spring 40 may be secured in slot 41, and the outer end of spring 40 may be anchored by any suitable means to the body 11, so as to resiliently urge the rotor 30 rotatively about the axis of its pintles 32 and 33, in a counterclockwise direction as seen in FIG. 2. Suitable stop or limit means are provided to limit counterclockwise rotation of the rotor 30 to an initial position, such as is shown in FIG. 2, as at 42.

Additionally provided on the rotor body 31, adjacent to one end thereof and in general alignment with the shackle leg 27 is an operator pin or radial projection 45.

A plurality of shifter are best seen in FIGS. 6 and 7, and there generally designated 46. The shifters 46 are arranged in generally side-by-side, parallel spaced relation to define a horizontal row, and located in a lower region of the body 11, projecting forwardly therefrom, as through the front body wall 12. Each shifter may include a generally cylindrical outer end portion or button 47, the several buttons being respectively slidably mounted in guide holes 48 opening inwardly through the front body face 12 and into the lower cavity recess 22, as best seen in FIGS. 2 and 3. The buttons or depressible, push members 47 may be charateristically marked, as illustrated by numerals, or otherwise. The shifters 46 are each provided with a lateral projection or retainer, as at 49, for retaining the respective shifters against withdrawal through their receiving holes 48. Extending inwardly from each button 47, longitudinally thereof and transversely across the lower internal body recess 22, is a centrally open inner shifter part or frame 50. Each shifter frame 50 is disposed generally horizontally, extending generally diametrically across the inner end of its associated button 47, and is provided with an upstanding generally semi-circular boss or push tab 51 adjacent to and spaced inwardly from the inner end of the associated button 47. Inward, beyond the push tab 51, each shifter frame is generally rectangular and formed with a generally rectangular central opening 52 defined within a pair of parallel spaced, longitudinally extending side pieces 53 and 54, and a transversely extending end piece 55. Internally of the frame opening 52 of each shifter 46, projecting inwardly from the side piece 53, spaced between opposite ends of the opening, is an oblique, angulate or generally triangular tooth 56. Further, each tooth or cam 56 includes an oblique or inclined side edge 57, adjacent to the frame end piece 55, and a transverse edge 58 extending from the inner end of side edge 57 toward and generally normal to the frame side piece 53.

The shifters 46 extend transversely across the lower internal recess 22, generally coplanar with each other and generally tangent to the rotor 30, best seen in FIG 2. It will also be there seen that the inner end of each shifter 46, say the frame end piece 55, is captured within a receiving slot 60, for sliding reception therein. That is, the shifter 46 shown in FIGS. 2 and 3 is outwardly extended from the front face 12 of body 11 with only its cross piece 55 received in slot 60 and spaced considerably from the rear or inner end of the slot. However, the shifters 46 are depressible inwardly to the position shown in FIG. 6 of the second shifter from the left, wherein the button 47 is retracted toward the front body wall face 12 and the shifter frame 50 is retracted into the slot 60 to place the frame end piece 55 proximate to the inner slot end.

Resting on the bottom wall of internal body recess 22, spaced below the several shifter frames 50, is a strip or plate 61 which may extend substantially the entire length of recess 22 beneath all of the shifter frames 50. Further, the strip or plate 61 may be suitably fixed in position on the bottom wall of recess 22, as by appropriate shoulders, slots and the like formed in the recess. The strip or plate 61 is formed of resilient material, such as suitable metal or other, and may be fabricated, as by stamping, to provide along one longitudinal edge a plurality of parallel spaced, upstanding tabs 62. That is, the tabs 62 are arranged in their parallel spaced facing relation, aligned in a row longitudinally along the recess 22. As best seen in FIG. 6, each tab 62 upstands into a respective opening 52 closely along and inward of side piece 53. In the withdrawn, extended or undepressed condition of each shifter 46, its associated tab 62 is located along frame side piece 53, between the frame end member 55 and tooth 56. Upon inward movement or depression of a shifter 46, its associated tab 62 rides on the inclined or oblique edge 57 of the associated tooth 56, being resiliently deflected thereby, and snaps over the tooth into shifter retaining engagement with the shifter depressed. Thus, the tab 62 define resilient leaf springs for retaining the shifters in depressed position.

The strip or plate 61 is further formed along the longitudinal edge opposite to the several tabs 62 with a plurality of generally coplanar, spaced upstanding tabs 63 each upstanding into a respective frame opening 52 adjacent to a respective boss 51. The several tabs 63 are similarly resiliently deflectable, defining leaf springs yieldably urging the respective shifters 46 outwardly and permitting of inward movement or depression of the shifters by resilient deflection of the leaf springs or tabs 63. Thus, each of the shifters 46 is resiliently inwardly depressible against the resilient flexure of its associated leaf spring 63 to a depressed condition in which the associated leaf spring 62 retains the shifter against the withdrawing force of its deflected leaf spring 63.

A shifter release member is generally designated 65, and includes an elongate strip or plate 66 extending closely beneath and transversely of each shifter frame 50. The cross-plate 66 is formed with a plurality of notches or openings 67 each receiving a respective leaf spring 62. The release plate 66 is displaceable in the body 11 transversely of the shifters 46, and provided on one end with an extension or button 68 projecting externally of the lock body through the body side edge 17. The several leaf springs 62, as described hereinbefore, function as detents for holding a fully depressed shifter 46 in its depressed position. Further, the leaf springs 62 in their interfitting relation with release plate 66 urge the latter toward the body side wall 17 for yieldable extension therefrom of button 68. Upon manual pushing of button 68, the several leaf springs or detents 62 are resiliently deflected to release any of the depressed shifters from their depressed and detented condition.

The release means 65 may be suitably mounted in the body 11, as by its button 68 being slidably received in a body hole 70 opening from one end of recess 22 outwardly through body side edge 17, and the distal end of plate 66 being slidably received in an internal slot 71.

The inner end 72 of shackle leg 27 facing downwardly toward the rotor 30, may be formed with an open ended slot 73 disposed in a plane generally normal to the axis of the rotor nd facing downwardly toward the latter. In addition, a blind hole 74 may be formed in the shackle leg 27 extending longitudinally of the slot 73 and opening downwardly into the latter. A generally cylindrical latch or shackle retainer 75 is disposed slidably within the hole 74, and provided with a radial push member or finger 76 depending into slot 73. Suitable resilient means, such as a coil compression spring 77 may be associated with the latch or retainer 75 to urge the latter outward with respect to the shackle leg 27. In the locked shackle position, with leg 27 retracted, as shown in FIGS. 2 and 4, the latch 75 projects into cavity 23 and is retained by shoulder 24 against shackle withdrawal. Upon retraction of the latch 75 into hole 74 sufficiently to clear shoulder 24, the shackle will be released for outward movement to a limiting position wherein latch 75 will engage internal shoulder 25. By the generally cylindrical configuration of cavity 23, the shackle leg 27 and shackle 20 may rotate, as desired.

Assuming the locked position of FIG. 2, it is necessary to rotate rotor 30 in the direction of arrow 80, sufficiently to engage operator pin 45 with push member 76 to retract latch 75 and thereby release bolt or shackle leg 27, as described hereinbefore.

As each rotor slot 36 is provided with a respective tab 38 located in alignment with an associated shifter 46; and, as the shifter bosses 51 are movable generally tangentially of the rotor for engagement with an appropriately located tab 38, a proper sequential depression of shifters 46 will cause successive angular displacement of rotor 30 until latch 75 is retracted to unlock bolt 20.

More specifically, an initial rotor turning tab 38 is located in position to be engaged by one of the bosses 51 upon depression of its associated button 47. Upon depression of the proper shifter 46, the rotor 30 will be angularly displaced just sufficiently to locate the next angularly adjacent turning tab 38 is position for turning engagement by another, proper boss 51. The first depressed shifter 46 is retained in its depressed condition by the detent spring 62, as described hereinbefore. This procedure is repeated in the proper order of shifter to open the lock 10.

An inadvertent or accidental depression of a shifter 46 is released by inward depression of release button 68. Of course, all previously depressed shifters are thereby released, and the rotor 30 is released to return to its initial position.

The lock mechanism is highly secure against being picked for many reasons, including the very great number of possible combinations and the absence of falling tumblers or other clue to a successful picking procedure. For example, an incorrectly depressed shifter is fully depressible and there retained, all in the same manner as a correctly selected shifter, without revealing information, except that the lock remains closed. Further, as each boss 51 is spaced from its adjacent button 47, there will not be a jamming against a previously incorrectly depressed shifter. In addition to a simple "five" digit combination, there may be provided combinations of more than five digits, as desired. For example, after a predetermined permutation of five digits of pushed, if the fifth pushed button is held depressed and the release button 68 is simultaneously depressed, the first four pushed buttons will be released for further use, without the rotor having been released from its previously angular displacement. Such procedure, of course, further enhances the security against the lock being picked.

From the foregoing, it is seen that the present invention provides a combination lock of the push button type which is extremely simple in construction for economy in manufacture, while of high security against tampering and picking, capable of economic mass production, and otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A combination lock comprising a body, bolt means shiftable in said body between locked and unlocked positions and releasably retained in locked position, a rotor rotatable in said body and resiliently urged in one angular direction toward an initial position, operator means associated with said rotor for releasing said bolt means upon rotor rotation in the other anuglar direction to an opening position angularly spaced from said initial position, a plurality of resiliently depressible shifters mounted in said body for movement generally tangent to said rotor, shifter holding means in said body for releasably retaining shifters in depressed position, and selectively located turn tabs on said rotor for sequential rotor turning engagement by successively depressed shifters to rotate said rotor to said unlocked position.

2. A combination lock according to claim 1, said shifter holding means comprising a plurality of resilient detents each located for snap interengagement with a respective shifter on movement thereof into its depressed position, and shifter release means engageable with said detents and displaceable transversely of said shifter movement to release the shifters, said shifter release means extending exteriorly of said body for manual actuation to release said shifters.

3. A combination lock according to claim 2, said detents each comprising a leaf spring resiliently deflectable transversely of shifter movement, and said shifter release means comprising an elongate member in bearing engagement with said detent leaf springs and shiftable transversely of shifter movement to deflect said detent leaf springs and release all retained shifters.

4. A combination lock according to claim 3, in combination with a plurality of resiliently deflectable shifter leaf springs urging said shifters out of their depressed positions.

5. A combination lock according to claim 4, in combination with a cross-plate in said body extending generally transverse of said shifter movement, a plurality of generally parallel facing tabs upstanding from said cross-plate and defining said detent leaf springs, and a plurality of generally coplanar spaced tabs upstanding from said cross-plate and defining said shifter leaf springs.

6. A combination lock according to claim 2, said rotor comprising an elongate member having a longitudinal axis of rotation extending transversely of shifter movement, and said turning tabs projecting generally radially from said elongate member at longitudinally spaced locations therealong each generally proximate to a respective shifter for turning engagement thereby.

7. A combination lock according to claim 6, said shifters each including a transverse projection for turning engagement with the associated turning tab.

8. A combination lock according to claim 6, said elongate rotor member having a plurality of longitudinally extending radially outwardly opening slots, and a plurality of blades in said slots and having projections defining said turning tabs.

9. A combination lock according to claim 1, in combination with bolt locking means in said body releasably locking said bolt in its locked position, and said operating means comprising a projection carried by said rotor for movement therewith into unlocking engagement with said bolt locking means.

10. A combination lock according to claim 1, said body comprising a generally flat padlock body, said bolt comprising a shackle extending from an edge of said padlock body, said rotor extending generally laterally of said padlock body with its axis of rotation generally normal to the direction of movement of said shackle.

11. A combination lock according to claim 10, said body comprising a pair of complementary facing sections; said sections being configured on their facing sides to receive and mount said shackle, rotor and shifters.

* * * * *